United States Patent [19]

Meister

[11] Patent Number: 4,788,516

[45] Date of Patent: Nov. 29, 1988

[54] ENCLOSED ELECTROMAGNETIC RELAY

[75] Inventor: Jack B. Meister, Convent Station, N.J.

[73] Assignee: Beta Mfg. Co., Warren, Mich.

[21] Appl. No.: 86,021

[22] Filed: Aug. 17, 1987

[51] Int. Cl.[4] ..... H01H 51/22

[52] U.S. Cl. ..... 335/84; 335/78; 335/128

[58] Field of Search ..... 335/78, 79, 80, 81, 335/82, 83, 84, 85, 121, 128, 131, 132, 231

[56] References Cited

U.S. PATENT DOCUMENTS

| | | | |
|---|---|---|---|
| 3,226,606 | 12/1965 | Erickson . | |
| 3,275,775 | 9/1966 | Hawkins . | |
| 3,331,042 | 7/1967 | Erickson et al. . | |
| 3,425,008 | 1/1969 | Magida et al. . | |
| 3,598,360 | 8/1971 | Merriner et al. . | |
| 3,605,054 | 9/1971 | Conrath et al. . | |
| 3,639,870 | 2/1972 | Benson . | |
| 4,087,773 | 5/1978 | Jencks et al. . | |
| 4,159,455 | 6/1979 | Bosch et al. | 335/81 |
| 4,225,835 | 9/1980 | Vrsnak et al. | 335/81 |
| 4,609,897 | 9/1986 | DeKoster et al. . | |

*Primary Examiner*—E. A. Goldberg
*Assistant Examiner*—Lincoln Donovan
*Attorney, Agent, or Firm*—Barnes, Kisselle, Raisch, Choate, Whittemore & Hulbert

[57] ABSTRACT

Relay comprising an electromagnetic coil wound an an insulating bobbin, the central cavity of which encloses a central spring-biased contact actuated by a magnetic armature in response to energization of the coil, to make or break contact with one or more fixed contacts also enclosed. A U-shaped member and heel plate, both of highly magnetically permeable material, surround the coil and complete the magnetic circuit for flux generated by the coil. In one modification a permanent magnet interposed into the cavity aids or repulses the flux generated by the electromagnet, depending on their respective directions. In accordance with another modification the bobbin and the enclosing coil are elongated to include a plurality of sets of contacts which are being simultaneously actuated.

13 Claims, 3 Drawing Sheets

ENCLOSED ELECTROMAGNETIC RELAY

This relates in general to electromagnetically actuated relays, and more particularly to small dimensional relays adapted for use in conjunction with other electronic components on a printed circuit board, or for other applications.

BACKGROUND OF THE INVENTION

For many prior-art applications requiring large numbers of highly reliable switching operations, such as in the telephone industry, it was customary to use reed relays comprising a pair of contacts sealed in an inert gas atmosphere into a glass tube. For operation, the latter was inserted into the gap of an electromagnetic coil. These reed relays were expensive to fabricate, required ferro-nickel material for the reeds which has a coefficient of thermal expansion equal to that of glass into which the ends were heat sealed. In order to carry a limited current, the contact ends were formed of precious metal diffused into the iron. Furthermore, the glass envelope was fragile, so that great care was required in fabricating and using such relays. Moreover, the relay resulting from insertion of the reed into the coil was magnetically inefficient without provision for a magnetic return path.

BRIEF DESCRIPTION OF THE INVENTION

Accordingly, it is the principal object of this invention to provide an improved relay which is as reliable than the prior-art sealed reed relays, but is cheaper and easier to fabricate, and more rugged to use.

Another object of the invention is to provide a small dimensional relay which is adapted for use with other electronic elements on printed circuit boards, or for other applications.

Still another object of the invention is to provide a small dimensional relay that is sensitive to operation in response to the small amounts of flux generated by current available to electromagnets from solid state driving elements in conventional computer circuits.

These and other objects are realized in a miniature electromagnetically actuated relay of the present invention in which the movable armature and contacts are completely encapsulated within the central cavity of the bobbin on which the electromagnet is wound. The latter, which is of elongated rectangular section, with the corners rounded, is surrounded, end-for-end, by a U-shaped strap and heel piece, both of magnetic material, which provide a return path for the magnetic flux generated by current passing through the electromagnet. In the embodiment under description, the common contact disposed to move in the cavity of the bobbin between a pair of fixed, normally-open and normally-closed contacts, comprises a precious metal double-face button supported by a beryllium-copper spring carrying a steel armature. The spring for the common contact has its fixed end anchored to the external end of the bobbin in internal welded contact with the U-shaped strap, which is integrally formed with an externally-depending terminal. The normally-open and normally-closed contacts are respectively supported by metal strips attached to opposite walls of the internal cavity of the bobbin, positioned to engage the armature contact to open or close, depending on whether the electromagnet is energized or not. The normally-open and normally-closed contacts are also connected to externally-depending terminals. A pair of power terminals are respectively connected to opposite ends of the electromagnet coil. Thus, the fixed and movable contacts are all completely enclosed within the cavity of the insulating bobbin on which the electromagnet coil is wound.

When voltage is applied to the coil, current flows through it, generating a magnetic flux flowing through the central cavity in the direction of the axis of the coil. The total flux is a function of the voltage applied, the current generated, and the reluctance of the magnetic circuit. In the magnetic circuit, the flux flows through the U-shaped strap, the magnetic armature attached to the common terminal, the contacting pole face, and the magnetic heel piece. The flux generated between the armature and the pole face generates a force which attracts the armature to the pole face, thus causing the normally-closed contact to open, and closing the normally-open contact.

The switch of the present invention has the advantage that placing the contact and armature mechanism inside permits the coil volume to assume a larger proportion of the total volume of the relay, than is the case in conventional prior-art designs, in which an external pole piece is used, and the contact assembly is outside of the coil.

It has been found, using the switch of the present invention that for a given voltage input a lower current can generate the same force, and thus, a given power input to the coil will run cooler, dissipating more heat, enabling the operation of the relay to be more efficient.

Furthermore, the use of edge lay and inlay material in the normally-open and normally-closed contact element provides flat contacts which can be precisely located in the bobbin, resulting in no need for adjustment.

Furthermore, the construction of the switch of the present invention is such that the armature and all moving parts, and the contacts, are inside of the coil and are thus protected against dust and foreign particles. When the relay of the present invention is used on a printed circuit board in conjunction with other electronic components which require the use of a conformal coating to protect the elements against moisture, this relay resists entry of the coating material into the area of the armature and contacts, thus eliminating the necessity for the relay to have an additional protective cover.

It will be apparent from the foregoing that in the case of the relay of the present invention, the volume is smaller, the coil is smaller, and the relay operates cooler than in the case of prior-art relays operating to produce commensurate amounts of magnetic flux.

Further, because the relay of the present invention is constructed so that the contacts and armature are protected, the relay may be readily handled with less chance of damages, or need for readjustment.

It will further be understood that by lengthening the bobbin and its cavity in a direction transveral to the axis of the electromagnet, a plurality of sets of normally-open and normally-closed contacts may be enclosed, for servicing a series of electrical circuits, which may be connected or electrically isolated.

A particular feature of the relay of the present invention is the inclusion, in the internal cavity of the electromagnet, of a small permanent magnet of one of the magnetic materials well-known today, such as an alloy of aluminum, nickel and cobalt, known by the trademark ALNICO, or a magnetic ceramic, or another of the well-known permanent magnetic materials. This is disposed across the cavity of the bobbin, between the normally-open and normally-closed contacts, and electrically isolated therefrom, if the magnet itself is not an insulator. This permanent magnet serves to augment or oppose the flux generated in the coil, depending on the direction of the electromagnet current and the orientation of the magnetic poles of the permanent magnet.

It is contemplated that the use of a permanent magnet in the manner indicated will accomplish the following.

Although flux generated by the permanent magnet is insufficient to operate the relay, causing the common contact to open the normally-closed contact, or close the normally-open contacts, it should result in less flux being required from the coil to operate the relay, when the voltage polarity of the coil is such that it aids that of the permanent magnet. This would result in cooler operation, and would permit a smaller relay to be built. Furthermore, the permanent magnet may be so designed that it generates enough magnetic flux to hold the relay closed as long as necessary with no heat being generated by the coil. The coil is designed so that when it is energized with current of the opposite polarity, it will cancel the effect of the flux generated by the permanent magnet, causing the contacts to resume their deenergized state.

Such a relay can be operated with only short pulses of current of the proper polarity, and would be locked in a desired position until an electrical pulse of the opposite polarity is applied to the coil.

These and other objects, features, and advantages will be apparent to those skilled in the art upon a study of the detailed specification hereinafter with reference to the attached drawings.

SHORT DESCRIPTION OF THE DRAWINGS

DETAILED DESCRIPTION OF THE INVENTION

Figure 1:
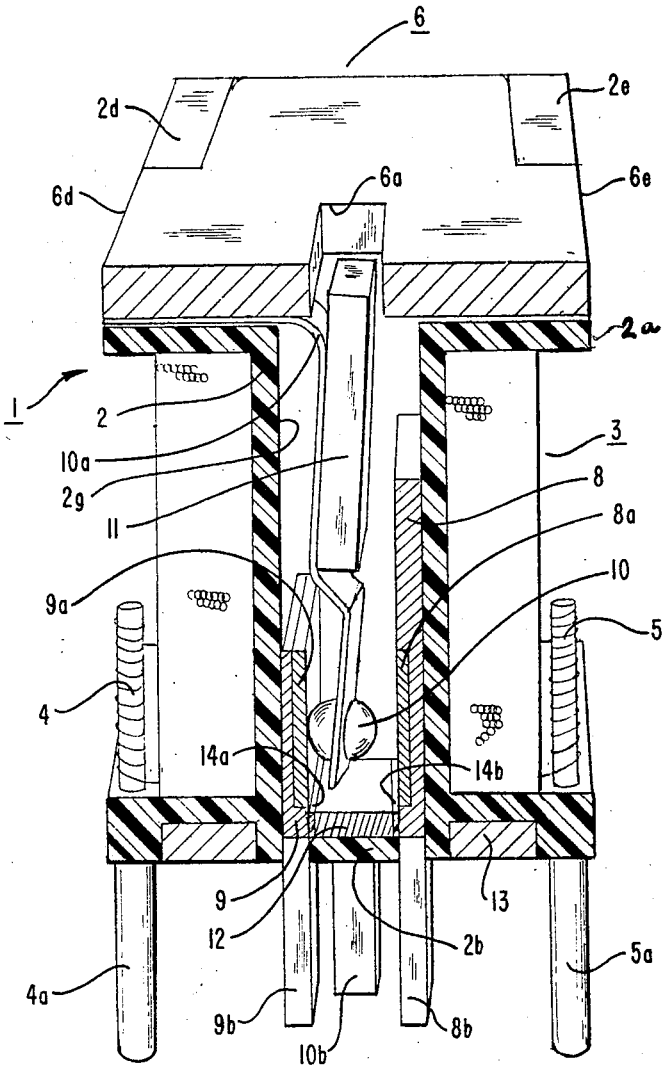
FIG. 1 is an enlarged front view, partly in section, of the relay of the present invention.
Figure 3:
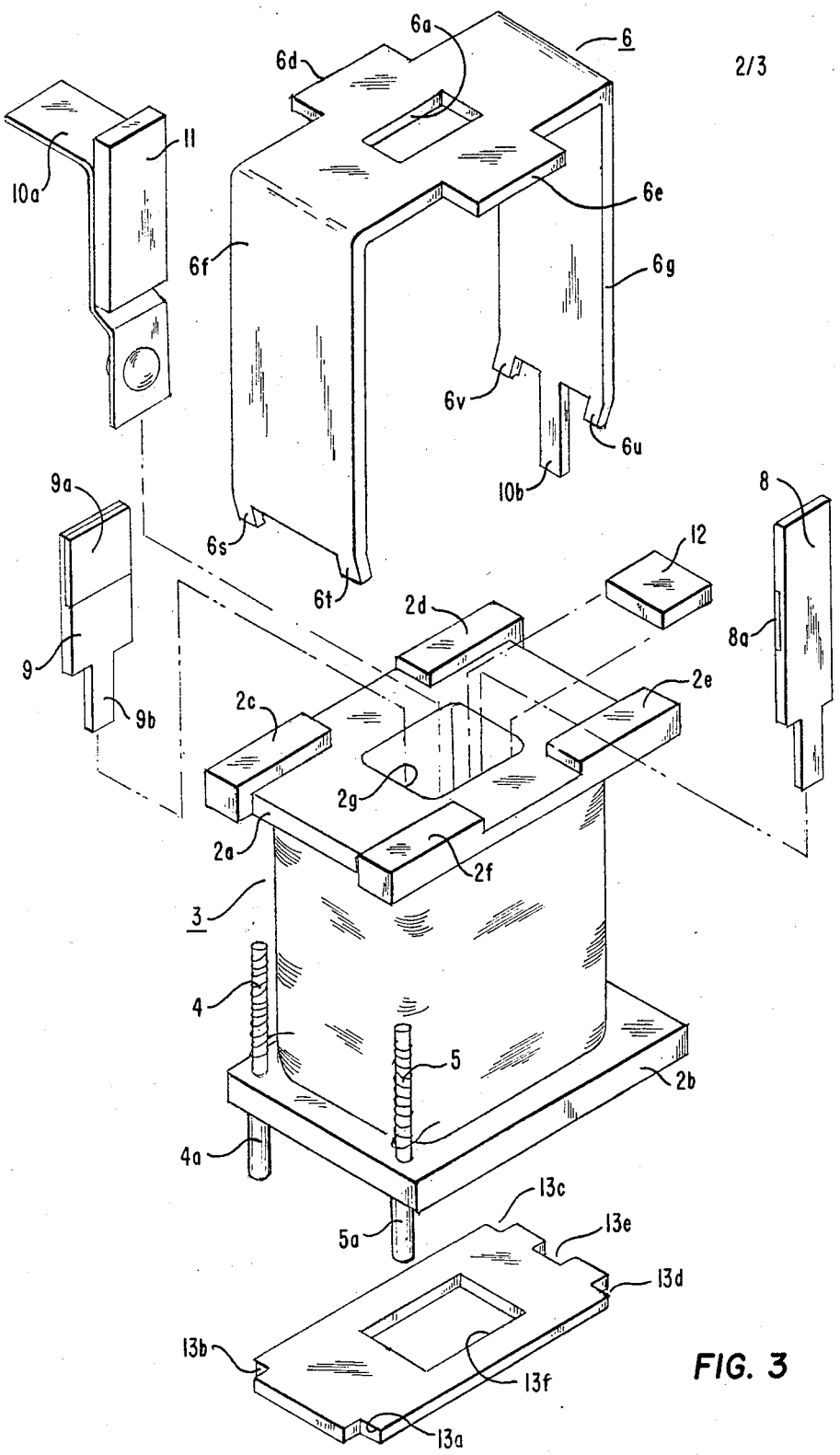
FIG. 3 is an exploded perspective view of the relay of the present invention shown in partial section in FIG. 1.

Referring to FIG. 1, there is shown a partial section, through the center, substantially enlarged, of the relay of the present invention which is of general elongated rectangular form with rounded corners. In a preferred commercial embodiment of the invention which is adapted for application to printed circuit boards for use in computer and other electronic circuits, the overall dimensions of the switch 1 excluding the terminals, are, say, 0.700 inch in height, along the axis of the coil, 0.770 inch long and 0.535 inch wide. FIG. 3 shows the switch 1 in disassembled exploded relation, to indicate how the parts go together. The assemblage includes a bobbin 2 of insulating material, comprising a rigid plastic, such as nylon. This has a recessed spool portion having external dimensions 0.2 inch wide, 0.4 inch long, and 0.49 high along the axis. The spool portion is sandwiched between rectangularly-disposed end-flanges **2*a* and 2*b* which may be, say, 0.55 inch wide, 0.77 inch long, which are generally rectangular with rounded corners. The upper flange 2*a*, of which the central portions are 0.031 inch thick, is increased in thickness at each of its corners to form a plurality of rectangular raised tabs, 2*c*, 2*d*, 2*e*, and 2*f*, which serve as fastenings to accommodate the U-shaped magnetic return strap 6**, as will be described hereinafter.

The lower flange **2*b* is about twice as thick around its inner and outer peripheries and is recessed in the intervening areas on its lower surface to accommodate heel plate 13**, in a manner shown in the drawings.

An electrical coil 3 comprising a number of layers of insulated copper magnet wire, is wound onto the bobbin 2 in a conventional manner, and terminates at its respective ends in a pair of terminal posts 4 and 5, which are rigidly fastened normal to the inner surface at opposite positions on the flange **2*b* at the lower end of spool of bobbin 2, being connected to the respective terminal posts 4*a*, 5*a***, which extend vertically downward, say, 0.22 inch from its lower surface.

The internal cavity **2*g* of the coil 3 in the present embodiment is, say, 0.15 inch wide, 0.35 inch long, and 0.57 inch along the axis of the coil, and terminates at its lower end in a flat insulating closure 2*b*, which is 0.05 inch thick, and is integral with the extended inner walls of the cavity. The cavity 2*g* encloses the normally-open and normally-closed contacts 8 and 9 which are located in diametrically-opposite positions on the walls of the cavity, and the intervening spring-biased common terminal 10, to which is connected the magnetic armature 11**.

In the present embodiment, the normally-open and normally-closed contact posts 8 and 9 comprise elongated rectangular members of low carbon steel and of brass, respectively, which are, say, 0.35 inch wide and 0.025 inch thick, being fastened near the center of the cavity **2*g*, as measured along the coil length, to opposite positions on its inner walls. The contact posts 8 and 9 are extended in the direction of the coil axis, with their lower ends terminating in the respective terminals 8*b* and 9*b* of reduced cross-section, which are anchored in and extend externally downward from the lower surface of the insulating closure 2*b*. The contact post 8 extends 0.38 inch to its upper end from the lower end of cavity 2*g*. Centered along the length of post 8 about 0.12 inch from the lower end of the cavity 2*g* is a contact member 8*a*** comprising a silver inlay mounted in steel, which is, say, 0.0125 inch thick, 0.16 inch parallel to the axis of the coil, and, say, 0.35 inch wide perpendicular to the coil axis.

The contact post 9 extends 0.2 inch to its upper end above the lower end of cavity **2*g*. A silver edge lay in brass 9*a* corresponds in composition and size to the inlay 8*a*, and is disposed on terminal 9 exactly opposite the latter. Inlay and edge lay 8*a* and 9*a* provide the bases for engaging opposite faces of the common contact 10. The latter comprise a pair of silver buttons, semispheriod in form, which extend out, say, 0.03 inch in diametrically-opposite directions from the lower face of the common contact arm 10*a*. The latter comprises a flat leaf spring of, for example, a beryllium copper alloy, about 0.2 inch wide and 8 mils thick, the lower leg of which supports the double-faced contacts 10, and which leg extends upward therefrom, parallel to the axis of bobbin 2, for about 0.2 inch, at which plane it is bent through about a 45 degree angle, extending 0.05 inch in the direction of the contact post 9, and then again being bent upward, extending about 0.3 inch to the upper end of the cavity 2g**.

At its upper end, spring 10a is bent through a circular configuration, so that the upper outwardly-directed arm forms about an approximate 90 degree angle with the lower portion, to provide an anchor which fits over the upper face of flange 2a of the bobbin 2, being welded to the under surface of the U-shaped strap 6, as described hereinafter.

Secured to the outer face of the spring 10a above the 45 degree bend, is the magnetic armature 11, which is a rectangular member of low carbon steel. In the present embodiment this is, say, a little over 0.3 inch long, 0.2 inch wide and, say, 0.05 inch thick.

The U-shaped strap 6, which is formed from a sheet of low carbon steel, say, 0.05 inch thick is 0.77 inch in overall length across the top, and 0.4 inch wide, except for the centered lateral tabs 6d and 6e, connected to sides 6f and 6g which are 0.35 inch wide and extend out 0.05 inch on each side. These are designed to fit into and dovetail with the upper surface of end flange 2a, so as to be flush with the bosses 2c, 2d, 2e and 2f on the corner surfaces. This arrangement serves to hold the U-frame 6 securely in place on end flange 2a, and in secure contact with the upper surface of the upper end of the spring 10a which supports the central double-headed contact 10.

Figure 2:
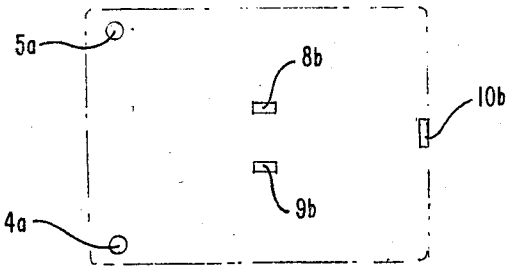
FIG. 2 is a bottom view of the relay shown in partial section in FIG. 1, showing the positions of the electrical terminals.

The top of the U-shaped strap 6 also includes a central rectangular opening 6a, which is 0.08 inch wide and 0.2 inch long, which accommodates the upper end of the armature 11, when the spring member 10a is fastened in place between the upper surface of flange 2a and the under surface of the top of U-shaped strap 6. The opposite sides 6f and 6g of U-shaped low-carbon steel strap 6, which are, say, 0.35 inch wide, extend down about 0.7 inch on each side, and terminate in tabs 6s, 6t, 6u, and 6v which lock into place on the rectangular heel plate 13. The latter is, say, 0.52 inch wide and 0.65 inch long and 0.05 inch thick, and has edge slots 13a, 13b, 13c and 13d which are designed to accommodate and mate with the tabs 6s, 6t, 6v and 6u on the U-shaped strap 6. Heel plate 13 has an additional edge slot 13e which accommodates the terminal 10b which is connected ultimately to the double-headed central contact 10. Heel plate 13 also has a rectangular central opening 13f, which is 0.2 inch wide and 0.25 inch long, which is designed to seat in the lower surface of end flange 2b and to accommodate the lower end walls of the cavity 2g, which are connected by the insulating platform 2b which is, say, 0.05 inch thick. The latter provides central openings, as shown on FIG. 2, which accommodate terminals 8b and 9b which are respectively connected to the normally-open and normally-closed relay contacts 8 and 9.

Typical operating parameters for relays of the type described in the following paragraphs and as follows.

Typical Specifications

1

Coil Voltage: 12 V D
Coil Current: 200 Milliamperes Max
Contact Configuration: SPDT
Contact Current Rating: 30 Amperes Inductive
Expected Life: 75,000 Operations
Duty: Continuous
Coil Resistance: 60 ohms

2

Coil Voltage: 24 VDC
Coil Current: ½ Amperes Max
Contact Configuration: SPST NU
Contact Current Rating: 5 Amperes Resistive
Expected Life: 6,000 Cycles
Duty Intermittent: 5 Seconds on (max) 20 Seconds Off (min)
Coil Resistance: 65–75 ohm In accordance with a particular feature of the invention, a permanent magnet 12, which may comprise a rectangular member of a highly magnetic material such as, for example, ALNICO, which is a trademark for a magnetic material having aluminum, nickel, and cobalt as its principal ingredients, is interposed into the base of the cavity 2g, resting on the insulating platform 2b, below the plane of the contacts 8a, 9a and 10. The ends of the permanent magnet 12 are insulated from the contact poles 8 and 9 by strips 14a, 14b of electrically insulating plastic such as that known by the trademark MYLAR, or other similar materials. In the alternative, the magnet 12 can be formed of non-conducting magnetic material, such as a permanent magnet formed from ceramic material. The magnet 12 may be selected from one of the many permanent magnetic materials available today, depending on the magnetic strength per unit volume, shock, temperature and resistance requirements.

Assume for a given size, the maximum degree of sensitivity has been accomplished, and that the relay requires 100 milliamperes to operate. Assume further that in a particular circuit the relay will be operated only a short time, and that it is possible for a given solid state component to drive five of these relays, and that such solid state component is only capable of delivering 300 milliamperes, instead of the 500 milliamperes which would normally be required. In such case, it is possible to increase the sensitivity of the relay of the present invention by augmenting the flux produced by the electromagnetic coil by the use of a permanent magnet, so designed and of sufficient magnitude, and of the proper polarity, that the flux of the permanent magnet aids the flux of the electromagnet. Thus, the added flux permits the resistance of the relay coil to be increased so as to draw a smaller current, e.g., 60 milliamperes, which, with the addition of the flux of the permanent magnet, is now able to operate the relay in the specific case cited, wherein the five relay load is 300 milliamperes, and within the current carrying capability of the solid states driving component.

Assume further that the five relays in the previous example are to be operated for an extended period, and that the solid states driving element can only handle the 300 milliampere requirement for, say, 10 milliseconds. In such case, the permanent magnet is designed to have sufficient strength to hold the relay energized, but not to operate it, as it is well-known that relays require considerably less energy to hold-in than to operate. Thus, a short pulse of current of the proper polarity through the coil to aid the flux emanating from the permanent magnet functions to operate the relay; and when the pulse disappears, the relay continues to hold-in by virtue of the flux of the permanent magnet. In order to unlock the relay, a pulse generating flux of opposite polarity is required.

Figure 4:
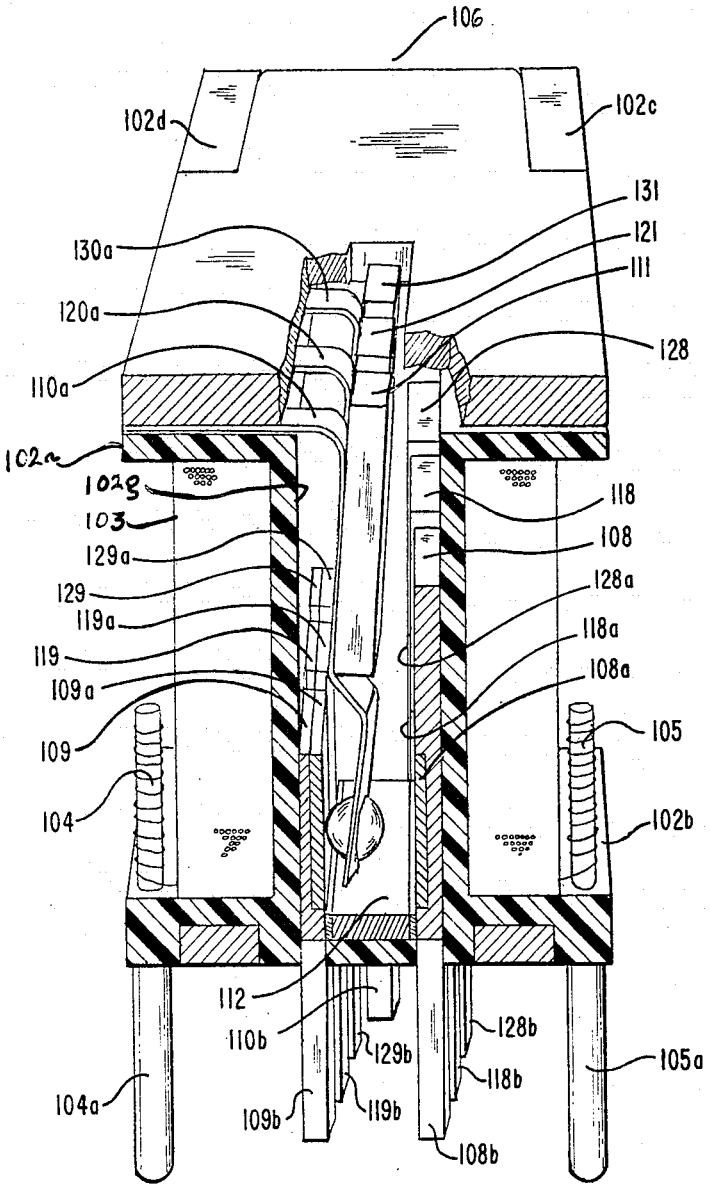
FIG. 4 is a view of an elongated modification of the relay of FIGS. 1 et seq., which is designed to accomodate a plurality of isolated contact pairs, which operate simultaneously when the coil is energized.
Figure 5:
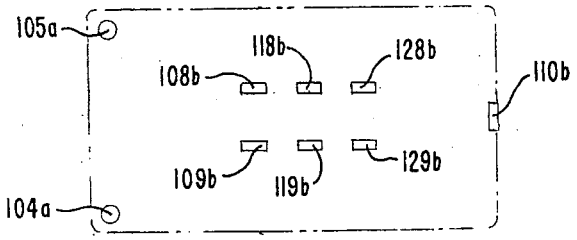
FIG. 5 is a view through the plane 5—5 of FIG. 4, showing the positions of the terminals for the contacts.

Another modification of the present invention is the relay combination 101 illustrated in FIGS. 4 and 5 in which the structure of the magnet shown in FIGS. 1 et seq. is elongated so as to accommodate a multiplicity of sets of contacts, instead of a single set of normally-open and normally-closed contacts as previously shown.

For example, there is shown a bobbin 102 wound with a magnet coil 103, which is similar to the bobbin 2 described with reference to FIGS. 1 et seq., except that it is elongated in a direction perpendicular to the principal axis of coil 103, the length depending on how many contacts it is desired to accommodate. In the present illustrative embodiment three sets of normally-open and normally-closed contacts will be shown, although it will be understood that the number of sets of contacts is not necessarily limited to three, and may be any convenient number.

As described hereinafter, it will be understood that the three sets of contacts described, namely 108, 109; 118, 119; and 128, 129 and their accessories, are substantially similar in form and function to contacts 8 and 9, previously described with reference to FIG. 1.

The normally-open contact posts 108, 118 and 128, and their corresponding contacts **108*a*, 118*a* and 128*a*, are spaced-spart in substantially parallel relation along one of the inner walls of the cavity 102*g***, in a direction perpendicular to the principal axis of the coil.

The normally-open contact posts 109, 119 and 129, and their corresponding contacts, **109*a*, 119*a* and 129*a*, are spaced-apart in substantially parallel relation along the inner wall of cavity 102*g*, opposite the wall on which contacts 108*a*, 118*a* and 119*a*** are disposed, and diametrcially opposite to the latter.

Disposed between each of the respective pairs of contacts **108*a*, 109*a*; 118*a*, 119*a*; and 128*a*, 129*a* are the common contacts 110, 120 and 130, the latter three will be understood to be similar to the common contact 10 described with reference to FIG. 1. Each of the common contacts 110, 120 and 130 is respectively supported by a corresponding spring 110*a*, 120*a*, or 130*a* which may, for example, be of beryllium-copper, to the outer face of each of which is secured a respective magnetic armature, 111, 121 or 131 similar to armature 11 described with reference to FIG. 1. The upper ends of the springs 110*a*, 120*a* and 130*a* are welded or otherwise secured to the under surface of the U-shaped member, pressed against the upper surface of end flange 102*a*. The latter, except for the fact that it is substantially longer in a direction perpendicular to the axis of the coil, is substantially similar to the end flange 2*a* described with reference to FIG. 1**.

The magnetic circuit comprising U-shaped strap 106 is completed by a heel plate 113 which conforms to the shape of the elongated relay structure.

It will be understood that a U-shaped strap 106 of low carbon steel, substantially similar in structure and material to strap 6 described with reference to FIG. 1, except for the dimensions of its top and sides in a direction to conform to its elongation, is superposed on the upper surface of the end flange **102*a*. In one embodiment of the multicontact pair relay, the strip 106 terminates at its lower end in a terminal 106*b*, which is grounded in tying common contacts 110, 120 and 130** together to ground potential.

In another embodiment insulation is interposed between common contacts 110, 120 and 130, and they are each connected to separate terminals in order to isolate each of the sets of contacts from each other.

As a further modification, a permanent magnet 112, similar to permanent magnet 12 in FIG. 1, can be interposed adjacent to each of the respective contact pairs 108, 109; 118, 119; and 128, 129 if desired to improve the sensitivity of the relay operation.

It will be understood that the invention is not limited to the particular structures or dimensions described herein by way of illustration, but only by the scope of the appended claims.

What I claim is:

1. An electromagnetic relay comprising in combination:

a bobbin of insulating material comprising a hollow spool sandwiched between a pair of end flanges, said spool and said end flanges defining a cavity centered along the principal axis of said spool;

a coil of electrically conducting wire wound around said spool and forming therewith an electromagnet constructed, upon energization of said coil, to generate a stream of magnetic flux in said cavity directed along said axis;

at least one fixed electrical contact rigidly attached to an inner wall of said cavity;

at least one movable contact;

means for suspending said movable contact in said cavity, adjacent to said fixed contact;

a magnetically actuable armature connected to said last-named means, and responsive to the flow of flux in said cavity to move said movable contact from a first position in open relation to said fixed contact, to a second position in closed relation with said fixed contact;

means comprising a magnetically permeable enclosure surrounding opposite sides of said coil externally for completing the magnetic circuit for said flux, wherein said magnetically permeable enclosure is electrically connected to said means for suspending said movable contact, and is magnetically connected to provide a magnetic flux path to said armature; and said movable contact comprising spring-biasing means anchored to said magnetically permeable enclosure.

2. An electromagnetic relay in accordance with claim 1 comprising at least two fixed electrical contacts fixed to opposite walls of said cavity in diametrically-opposite positions, wherein one of said fixed contacts is maintained in normally-closed relation to said movable contact under force exterted by said spring-biasing means, and the other one of said fixed contacts remains normally-open except in response to energization of said coil to generate magnetic flux which actuates said magnetically permeable armature to open contact with said normally-closed fixed contact and close contact with said normally-open fixed contact.

3. An electromagnetic relay in accordance with claim 1 which includes a permanent magnet disposed in said cavity positioned to aid the magnetic flux generated by energization of said coil.

4. An electromagnetic relay in accordance with claim 1 comprising a plurality of separate fixed electrical contacts rigidly fixed in spaced-apart relation along the same inner wall of said cavity, and comprising a plurality of separate movable contacts, disposed in spaced-apart relation along the length of said cavity, each of said movable contacts responsive to the flow of flux in said cavity to move from a first position in open relation to a respective one of said fixed contacts, to a second position inclosed relation with said respective fixed contact.

5. An electromagnetic relay in accordance with claim 2 which comprises a first series of fixed electrical contacts rigidly fastened in spaced-apart relation along the same wall of said cavity, and a second series of fixed electrical contacts rigidly fastened in spaced-apart relation in respectively diametrically-opposite positions along the opposite wall of said cavity;

a plurality of movable contacts each suspended in spaced-apart relation so that one of said movable contacts is adjacent each respective pair of contacts of said first and second series of fixed contacts;

wherein said movable contacts each include spring-biasing means suspended from said magnetically permeable enclosure, which movable contacts are maintained in normally-closed relation to the contacts of said first series under the force of said spring-biasing means, and the other said series of contacts remain normally-open except in response to energization of said coil.

6. The combination in accordance with claim 5 wherein said movable contacts are electrically tied together to a common potential.

7. The combination in accordance with claim 5 wherein each of said movable contacts is electrically insulated from the other said movable contacts.

8. An electromagnet relay comprising in combination:

a bobbin of insulating material comprising a central spool sandwiched between a pair of end flanges, and said bobbin having a cavity closed at one end, being centered along the principal axis of the spool, said spool being wound with an electromagnetic coil;

at least one pair of contacts, comprising one normally-open contact and one normally-closed contact, are disposed respectively, at diametrically opposite positions in directions substantially parallel to the principal axis of said spool;

a magnetic flux return path comprising a U-shaped metal strap interposed over the end-flange opposite the closed end of said cavity, and a heel plate secured to the open end of said U-shaped metal strap, said heel plate having a central opening which is constructed to accommodate the closed end of said cavity;

at least one common contact interposed into said cavity and supported by a leaf-spring arm to remain in engagement with said normally-closed contact under the bias of said leaf-spring;

an armature of magnetic material attached to said leaf-spring arm above said common contact and responsive to energization of said coil to move said common contact against said bias, to engage said normally-open contact;

the upper end of said leaf-spring arm of said common contact being secured to the underside of said U-shaped metal strap, being held in contact with the upper one of said end flanges;

said U-shaped metal strap having an opening centered in its zenith portion for accommodating and contacting the upper end of said armature;

said electromagnetic coil having a pair of external power terminals connected to its opposite ends;

each said normally-open and normally-closed contacts being connected to a separate external terminal; and said common contact being connected electrically to an external terminal depending from the open end of said U-shaped metallic strap.

9. An electromagnet relay comprising in combination:

A bobbin of insulating material comprising a central spool elongated in a direction transverse to the principal axis of said spool, said spool sandwiched between a pair of end flanges, and said bobbin having a cavity closed at one end, being centered along the principal axis of the spool and elongated in a direction transverse to the axis of said spool, said spool being wound with an electromagnetic coil;

a plurality of pairs of normally-open and normally-closed contacts, spaced-apart along the length of said cavity in a direction transverse to the principal axis of said spool, the members of each of said pairs being respectively disposed at diametrically opposite positions on opposite walls of said cavity;

a magnetic flux return path comprising a U-shaped metal strap interposed over the end-flange opposite the closed end of said cavity, and a heel plate secured to the open end of said U-shaped metal strap, said heel plate having a central opening which is constructed to accommodate the closed end of said cavity;

a plurality of common contacts interposed into said cavity in spaced-apart relation along the length of said cavity, and each respectively supported by a leaf-spring arm to remain in engagement with a respective one of said normally-closed contacts under the bias of its respective leaf-spring;

an armature of magnetic material attached to each of said leaf-spring arms above said respective common contact, and responsive to energization of said coil to move each of said common contacts against said bias, to engage a respective one of said normally-open contacts;

the upper end of each of said leaf-spring arms of said common contacts being secured to the underside of said U-shaped metal strap, being held in contact with the upper one of said end flanges;

said U-shaped metal strap having an opening centered in its zenith portion for accommodating and contacting the upper end of said of said armatures;

said electromagnetic coil having a pair of external power terminals connected to its opposite ends;

each of said normally-open and normally-closed contacts being connected to a separate external terminal; and said common contacts being connected electrically to an external terminal.

10. An electromagnetic relay in accordance with claim 9 wherein all of said common contacts are electrically tied together to an external terminal of common potential depending from the open end of said U-shaped metallic strip.

11. An electromagnetic relay in accordance with claim 9 wherein each of said common contacts is electrically insulated from the other said common contacts, and each of said common contacts is connected to a separate external terminal.

12. An electromagnetic relay in accordance with claim 8 wherein a permanent magnet is disposed adjacent said pair of normally-open, normally-closed contacts, being positioned to aid the magnetic flux generated by said electromagnetic coil.

13. An electromagnetic relay in accordance with claim 9 wherein a permanent magnet is disposed adjacent each said pair of normally-open, normally-closed contacts, being positioned to aid the magnetic flux generated by said electromagnetic coil.

* * * * *